US010549977B2

(12) United States Patent
Kim et al.

(10) Patent No.: US 10,549,977 B2
(45) Date of Patent: Feb. 4, 2020

(54) WATER DISPENSER AND CONTROL METHOD THEREOF

(71) Applicant: LG ELECTRONICS INC., Seoul (KR)

(72) Inventors: Yonghyun Kim, Seoul (KR); Siyeon An, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 76 days.

(21) Appl. No.: 15/641,483

(22) Filed: Jul. 5, 2017

(65) Prior Publication Data

US 2018/0002153 A1 Jan. 4, 2018

(30) Foreign Application Priority Data

Jul. 4, 2016 (KR) ..... 10-2016-0084444

(51) Int. Cl.

| | |
|---|---|
| ***B67D 1/08*** | (2006.01) |
| ***B67D 1/00*** | (2006.01) |
| ***B67D 1/12*** | (2006.01) |
| ***H05B 6/10*** | (2006.01) |

(52) U.S. Cl.

CPC ..... *B67D 1/0884* (2013.01); *B67D 1/001* (2013.01); *B67D 1/0888* (2013.01); *B67D 1/0895* (2013.01); *B67D 1/125* (2013.01); *B67D 1/1279* (2013.01); *H05B 6/10* (2013.01)

(58) Field of Classification Search

CPC .... B67D 1/0884; B67D 1/001; B67D 1/0014; B67D 1/0888; B67D 1/0895; B67D 1/125; H05B 6/10; H05B 6/108

See application file for complete search history.

(56) References Cited

FOREIGN PATENT DOCUMENTS

| | | | |
|---|---|---|---|
| JP | H 10-79294 | 3/1998 | |
| KR | 10-0300857 | 10/2001 | |
| KR | 10-2007-0071620 | 7/2007 | |
| KR | 10-2011-0096868 | 8/2011 | |
| KR | 10-2012-0112060 | 10/2012 | |
| WO | WO-2012134189 A2 * | 10/2012 | ..... F24H 1/121 |

OTHER PUBLICATIONS

JPH1079294 Description Translation PDF.*

* cited by examiner

*Primary Examiner* — Nicholas J. Weiss
(74) *Attorney, Agent, or Firm* — KED & Associates LLP

(57) ABSTRACT

A water dispenser and a method of controlling a water dispenser are provided. The water dispenser may control power output of an induction heater having a hot water module based on changes in flow rate of water supplied or a temperature of water discharged.

7 Claims, 10 Drawing Sheets

WATER DISPENSER AND CONTROL METHOD THEREOF

CROSS-REFERENCE TO RELATED APPLICATION

This application claims priority under 35 U.S.C. § 119 to Korean Patent Application No. 10-2016-0084444, filed on Jul. 4, 2016 in Korea, whose entire disclosure is incorporated herein by reference.

BACKGROUND

1. Field

A water dispenser and a control method for a water dispenser are provided.

2. Background

A water dispenser may be a device that supplies water and allows a user to take out as much water as desired. Water dispensers may be designed to supply water kept therein to an outside through a nozzle when a user operates a lever or a button. Such water dispensers may be designed to open a valve of a nozzle and supply water while a user operates a lever or a button and releases the lever or the button to check an amount of water filled in a cup or a container.

Water dispensers may be applied to various products in various fields, such as, e.g., a refrigerator and a water purifier. Water dispensers for refrigerators may be designed to automatically supply a predetermined amount of water when a user operates them. Water dispensers may supply not only just purified water, but also cold water and hot water.

When a flow rate of hot water supplied from a water dispenser that supplies hot water is not uniform, a large temperature change may occur in the hot water. When the flow rate is reduced, water may be overheated by a heater that heats water, and the heater may be damaged or the water may boil such that the hot water channel may be damaged or a safety accident may occur.

Korean Patent Application Publication No. 10-2012-0112060 discloses a hot water supplier that turns off a heater when the flow rate of water flowing inside is smaller than a minimum flow rate by sensing the flow rate of water supplied. However, according to this configuration of the related art, when the flow rate is unstable, the heater may turn off, so it may be impossible to obtained water at a desired temperature.

The above references are incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements wherein.

DETAILED DESCRIPTION

Figure 1:
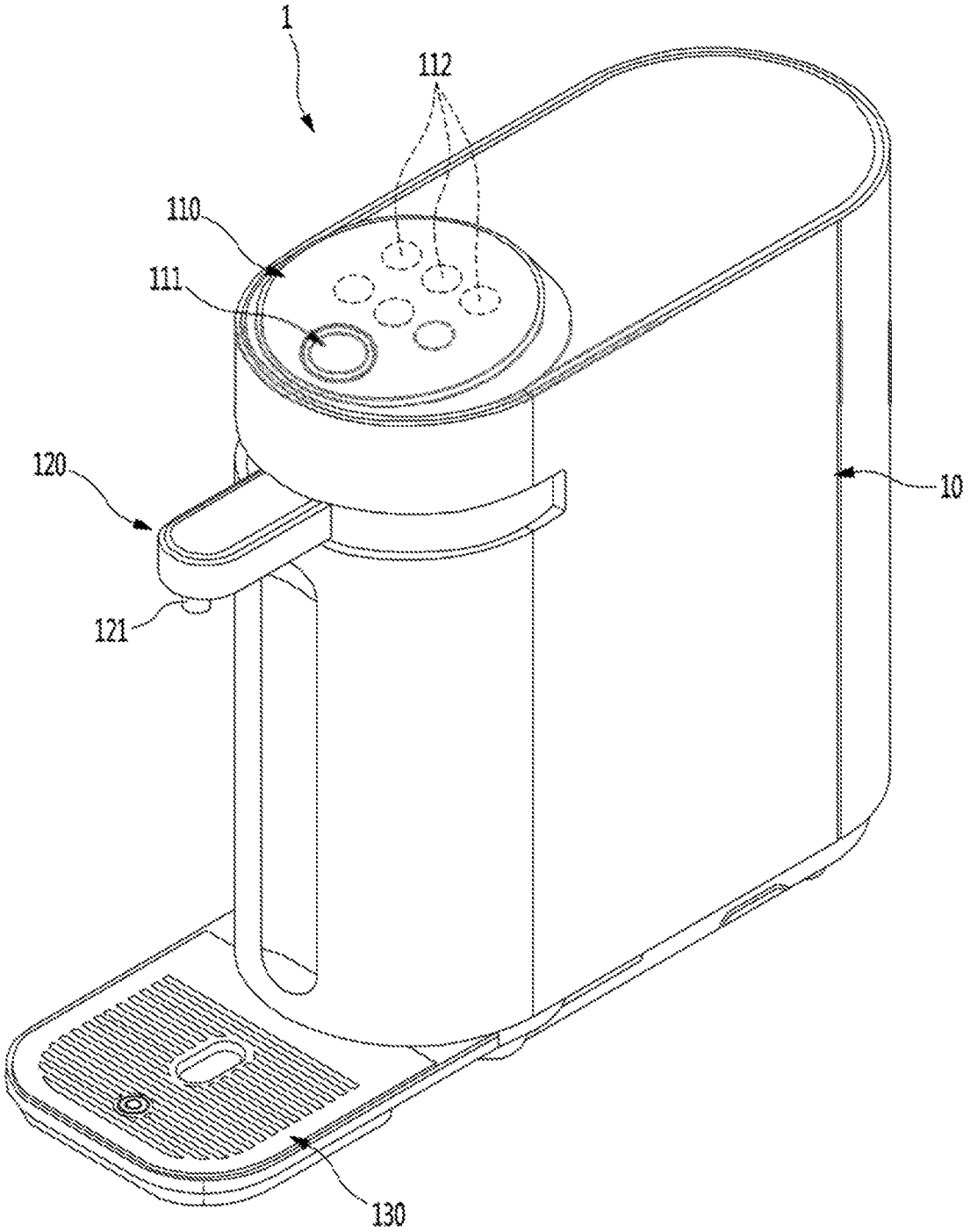
FIG. 1 is a perspective view of a water dispenser according to the present disclosure.

For explanation without limiting the disclosure and referring to FIG. 1, a water dispenser 1 according to the present disclosure may be a water purifier. The water dispenser 1 may have an external shape formed by a case 10. The case 10 may have rounded front and rear and flat top, bottom, and left and right sides. A filter that purifies water to be supplied, various valves including a hot water module 30 that heats the purified water, and various components to supply water may be provided in the case 10.

An operation unit (e.g. a control panel or display) 110 may be formed on the top of the case 10. The operation unit 100, which may allow a user to operate the water dispenser 1, may have a dispensing button 111 to dispense water. The operation unit 100 may further have a plurality of selection buttons 112 to select states of water to be dispensed from the water dispenser 1, for example, hot water, cold water, and purified water. A display that displays operation or setting states of the water dispenser 1 may be further provided.

A faucet 120 may be formed on the front of the case 10. The faucet 120 may be provided at a predetermined height from the bottom of the case 10 and may have a nozzle 121 that extends downward so that water may be supplied into a container under the nozzle 121.

A tray 130 may be provided under the faucet 120. The tray 130 may be provided under the faucet 120 to support a container and collect water that drops and overflows when water is dispensed. The tray 130 may be detachably coupled to the case 10. The tray 130 and the faucet 120 may turn together or independently on the case 10.

Figure 2:
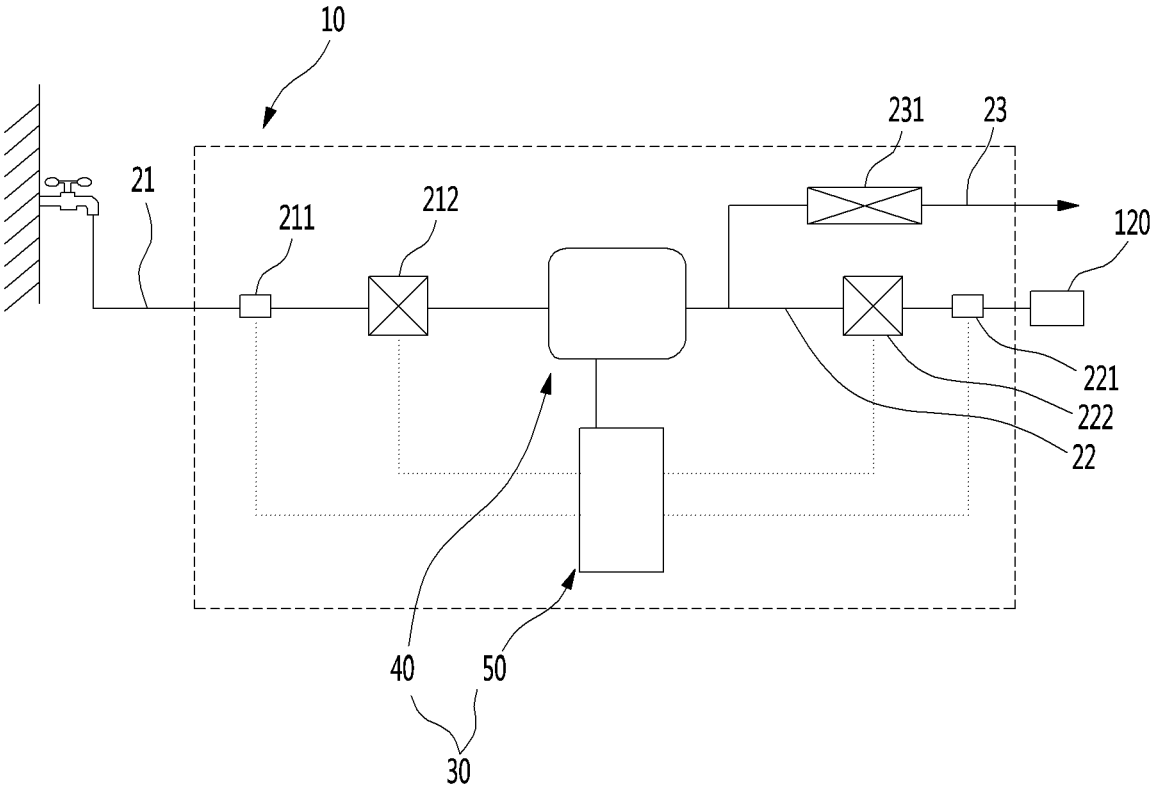
FIG. 2 is a block diagram schematically showing flow paths of hot water in the water dispenser.

Referring to FIG. 2, a supply pipe 21 connected to an external water source may be connected to the water dispenser 1, and water supplied through the supply pipe 21 may be discharged to the faucet 120 after being purified and heated. The water dispenser 1 may be supplied with raw water through the supply pipe 21 connected to the external water source. The supply pipe 21 may extend inside the case 10 and may be connected to the hot water module 30 to produce hot water.

A flow sensor 211 and a control valve 212 may be provided along the supply pipe 21 inside the case 10. The flow sensor 211 may sense or measure a flow rate of water supplied through the supply pipe 21. The control valve 212, which may have a structure capable of adjusting an opening ratio, may control the flow rate of water supplied through the supply pipe 21.

When too much water passes through a hot water tank 41 of the hot water module 30, the water may not be efficiently heated through the hot water tank 41 due to its high speed, so a temperature condition for the hot water may not be satisfied under this circumstance. Therefore, it may be possible to maintain an amount of water passing through the hot water tank 41 at a predetermined level using the control valve 212 so that hot water may always be dispensed at a predetermined temperature. The flow sensor 211 and the control valve 212 may be integrated.

Water may be supplied to the hot water module 30 through the supply pipe 21, and the water heated through the hot water module 30 may be sent to the nozzle 121 through a discharge pipe 22. A temperature sensor 221 to sense the temperature of water to be dispensed may be provided on the discharge pipe 22. The temperature of the water to be dispensed may be measured by the temperature sensor 221. The discharge valve 222, which may be opened/closed to discharge hot water, may be provided on the discharge pipe 22.

An exit path of the hot water module 30 may diverge and may be further connected to a vapor pipe 23. The vapor pipe 23 may be provided to discharge vapor, which may be produced when the water in the hot water tank 41 boils, to the outside. A safety valve 231 may be provided on the vapor pipe 231, so when a predetermined pressure over a set or prescribed pressure is generated, the safety valve 231 may open and discharge vapor to the outside.

The safety valve 231 may be provided to discharge vapor produced when hot water is heated in the hot water tank 41, and may prevent the internal pressure of the hot water tank 41 from being excessively increased by vapor. The safety valve 231 may open at a predetermined pressure and may have various structures that may smoothly discharge vapor from the hot water tank 41. An exit path from the safety valve 231 may be a drain pipe that extends out from the case 10.

Output of the hot water module 30 may be controlled by a controller 50. The controller 50 may control an output of the hot water module 30 based on the flow rate sensed by the flow sensor 211 or the water output temperature sensed by the temperature sensor 221, so that water flowing inside may be heated and dispensed at a predetermined temperature.

Figure 3:
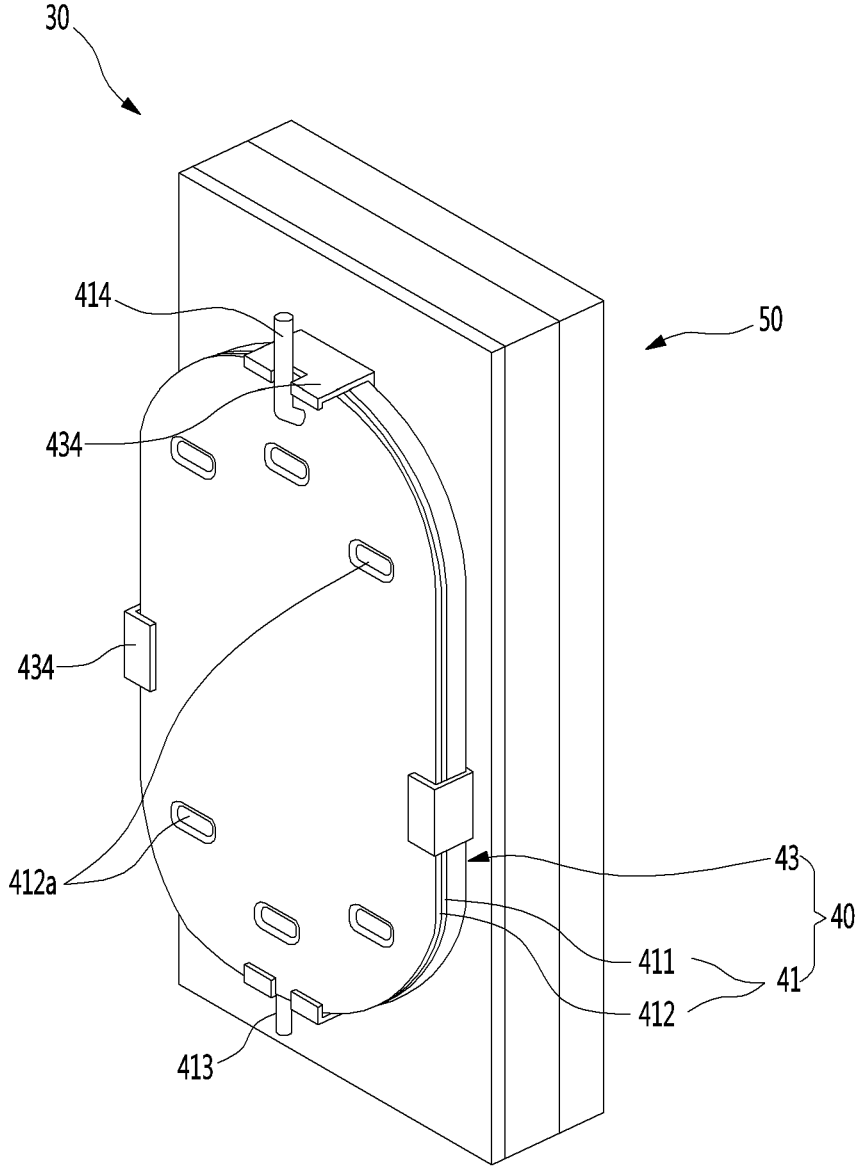
FIG. 3 is a perspective view of a hot water module of the water dispenser.
Figure 4:
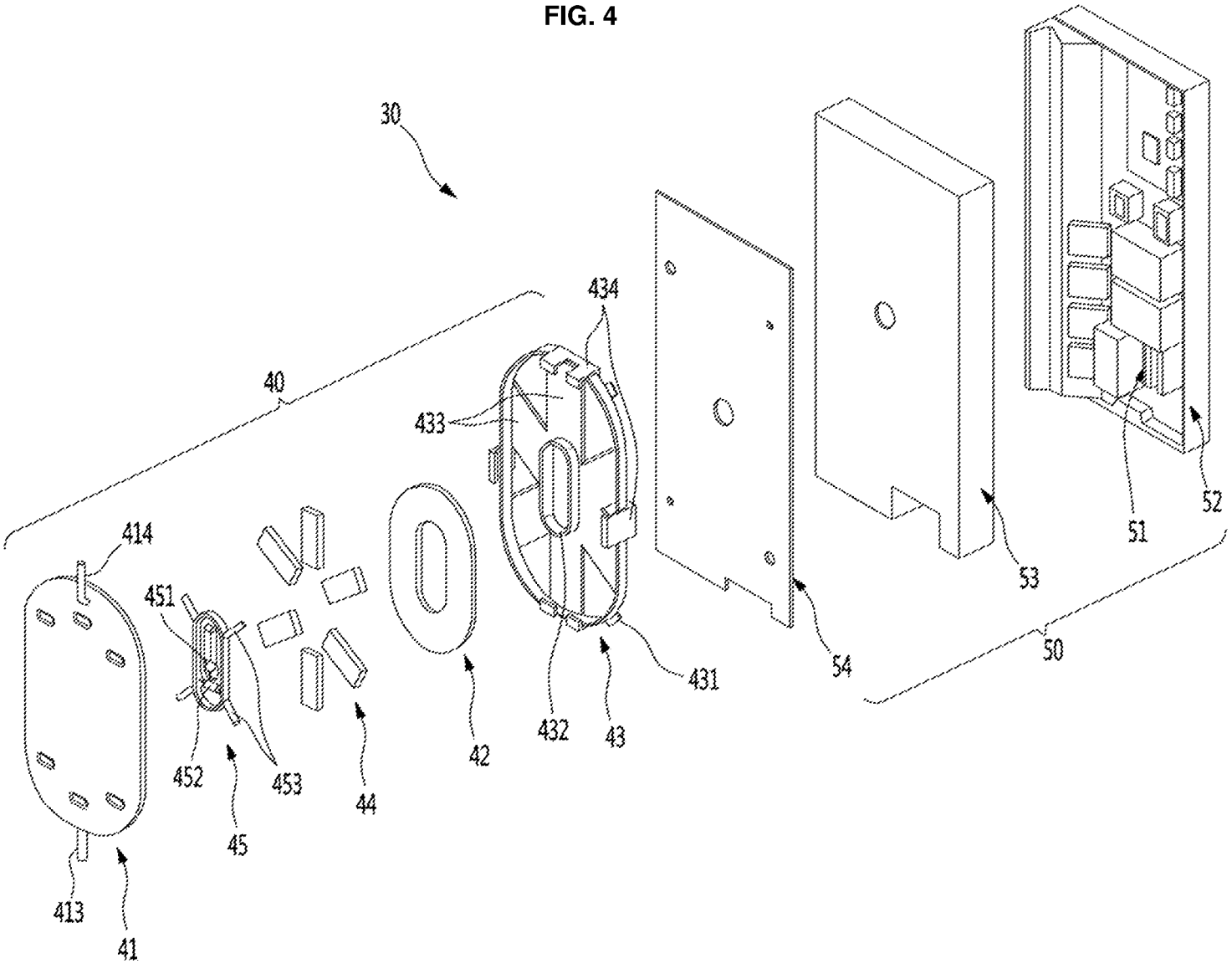
FIG. 4 is an exploded perspective view of the hot water module.

Referring to FIG. 3 and FIG. 4, the hot water module 30 may include an induction heating assembly or induction heater 40 configured to produce hot water and the controller 50 configured to control operation of the induction heating assembly 40. The induction heating assembly 40 and the controller 50 may be combined in one module and provided as a module in the case 10. The induction heating assembly 40, which may be provided to heat purified water supplied through the supply pipe 21 into hot water, may heat water using an induction heating principle.

The induction heating assembly 40 may include a hot water tank 41 through which water (which may be purified prior to entering the hot water tank 41) may pass, a working coil 42 to heat the water passing through the hot water tank 41, and a mounting bracket 43 on which the working coil 42 and the hot water tank 41 may be mounted. The mounting bracket 43 may provide a space to receive the hot water tank 41, the working coil 42, and ferrite cores 44. The mounting bracket 43 may be made of resin that may not ne deformed or damaged even at high temperature.

A bracket coupling portion or bracket coupler 431 that couples to the controller 50 may be formed at a corner of the mounting bracket 43. A plurality of bracket coupling portions 431 may be provided and ends of the bracket coupling portion 431 may be formed or extend in different shapes and directions. Accordingly, the induction heating assembly 40 may be fitted to the controller 50 and may be mounted at a set or prescribed position.

A bracket mount 432 to mount a sensor bracket 45 may be formed at a center of a side of the mounting bracket 43 on which the hot water tank 42 may be mounted. A tank temperature sensor 451 and a fuse 452 may be mounted at a center of the bracket mount 432.

The tank temperature sensor 451 to measure the temperature of the hot water tank 41 may be provided at a center of the sensor bracket 45. The tank temperature sensor 451 may measure the temperature at the center of the hot water tank 41 to determine the temperature of hot water without directly measuring the temperature of the hot water in the hot water tank 41. The tank temperature sensor 451 may maintain the temperature of hot water within an appropriate range. It may be possible to determine whether to further heat or stop heating hot water on the basis of the temperature sensed by the tank temperature sensor 451.

The fuse 452 may be mounted on the sensor bracket 45. The fuse 452 may cut power for the induction heating assembly when the water in the hot water tank 41 is excessively overheated.

A plurality of coil fixing portions or coil mounts 453 may be formed around the sensor bracket 45. The coil fixing portions 453 may extend outward from an outer side of the sensor bracket 45 to fix the working coil 42 on the mounting bracket 43. Two coil fixing portions 453 may be provided at each of the upper and lower portions of the sensor bracket 45 and may orthogonally extend from corners of the sensor bracket 45 so as to fix the working coil 42.

The working coil 42 may be provided on a front of the mounting bracket 43. The working coil 42 may form magnetic flux to generate heat in the hot water tank 41. When a current is supplied to the working coil 42, the working coil 42 may form a magnetic flux, and the hot water tank 41 may generate heat via the magnetic flux. The working coil 42 may be provided on the front of the mounting bracket 43 and may face a flat side of both sides of the hot water tank 41. The working coil 42 may be composed of several copper or other conductive wires, and the wires may be insulated. The working coil 42 may form a magnetic field or magnetic flux when a current is supplied to the working coil 42.

The front side (which may face the working coil 42) of the hot water tank 41 may be influenced by the magnetic flux formed by the working coil 42, whereby heat may be generated. A contour of the working coil 42 is shown, but wires of the working coil 42 may be wound around the bracket mount 432.

The ferrite cores 44 may be provided on the front of the working coil 42. The ferrite cores 44 may be provided to suppress a loss of current and may shield against magnetic flux. The working coil 42 may include a plurality of ferrite cores 44, and the ferrite cores 44 may be circumferentially arranged around a center of the working coil 42. The ferrite cores 44 may be fixed to core fixing portions or core mounts 433 of the mounting bracket 43. The ferrite cores 44 may be attached or fitted to the core fixing portions 433. The core fixing portions 433 may be circumferentially arranged similar to the ferrite cores 44.

Snaps 434 that may lock and fix edges of the hot water tank 41 mounted on the mounting bracket 43 may be formed around the mounting bracket 43. Accordingly, the working coil 42, the ferrite cores 44, the sensor bracket 45, and the hot water tank 41 may be combined with the mounting bracket 43 as a module.

The hot water tank 41 may be mounted on the front of the mounting bracket 43. The hot water in the hot water tank 41 may be heated via the magnetic flux formed by the working coil 42. Accordingly, water may be heated into hot water by the hot water tank 41. A shape of the hot water 41 may be flat and compact. The hot water tank 41 may have a shape corresponding to a shape of the induction heating assembly 40 to be able to be effectively heated when the induction heating assembly 40 is operated.

For example, the hot water tank 41 may be formed by bonding edges of a first tank panel or cover 411 having a flat plate shape and a second tank panel or cover 412 having a plate shape and recessed to form a channel or a storage space. An outlet pipe 414 that discharges heated water may be formed at a top of the hot water tank 41, and an inlet pipe 413 that supplies heated water may be formed at a bottom of the hot water tank 41. The hot water tank 41 may be instantaneously heated by induced electromotive force formed by the working coil 42 while water flows inside through the channel or the storage space from the inlet pipe 413 and is then discharged through the outlet pipe 414, whereby hot water may be discharged.

A side of the first tank panel 411 that faces the working coil 42 may be flat and close to the working coil 42, so an entire surface of the first tank panel 411 may be uniformly heated by an induced magnetic force generated by the working coil 42. A plurality of foamed spacers or pillars 412*a* may be formed at or on the second tank panel 412. The foamed spacers 412*a* may be recessed toward the first tank panel 311, so they may contact with an inner side of the first tank panel 411 when the first tank panel 411 and the second tank panel 412 are combined such that the channel or storage space may be maintained between the first tank panel 411 and the second tank panel 412. Accordingly, a space through which water may flow may be defined between the first tank panel 411 and the second tank panel 412 by the foamed spacers 412*a*. The foamed spacers 412*a* may be made from a material different from foam, and further, shapes other than shown in the figures may be used.

The plurality of foamed spacers 412*a* may be formed close to the inlet pipe 413 and the outlet pipe 414 and may be spaced from each other in a width direction of the hot water tank 41. The water in the hot water tank 41 may flow throughout an internal area of the hot water tank 41, so the water can be effectively heated by the working coil 42. The water flowing through the hot water tank 41 may be spread thin and wide so as to be quickly heated at a predetermined temperature by the working coil 42.

The controller 50 may be provided behind the induction heating assembly 40. The controller 50 may be connected with several valves and electronic devices including the induction heating assembly 40, the flow sensor 211, the control valve 212, the temperature sensor 221, and the discharge valve 222. The controller 50 may be composed of a plurality of parts to control the induction heating assembly 40 and other components.

The controller 50 may include a control PCB 51, a control case 52, and a control cover 53. The control PCB 51, which may be provided to control the induction heating assembly 40, may be mounted on the control case 52. The control PCB 51 may control valves connected to the induction heating assembly 40. The control case 52 may contain the control PCB 51 therein and may have an open side covered with the control cover 53. The control PCB 51 may be housed between the control case 52 and the control cover 53 combined with each other.

A shield plate 54 may be provided on the front of the control cover 53. The shield plate 54, which may be provided to prevent magnetic flux from transferring to the control PCB 51 when the induction heating assembly 40 is operated, may be provided throughout the entire front of the control cover 53. The shield plate 54 may be formed as a separate sheet and provided on the front of the control cover 53.

Figure 5:
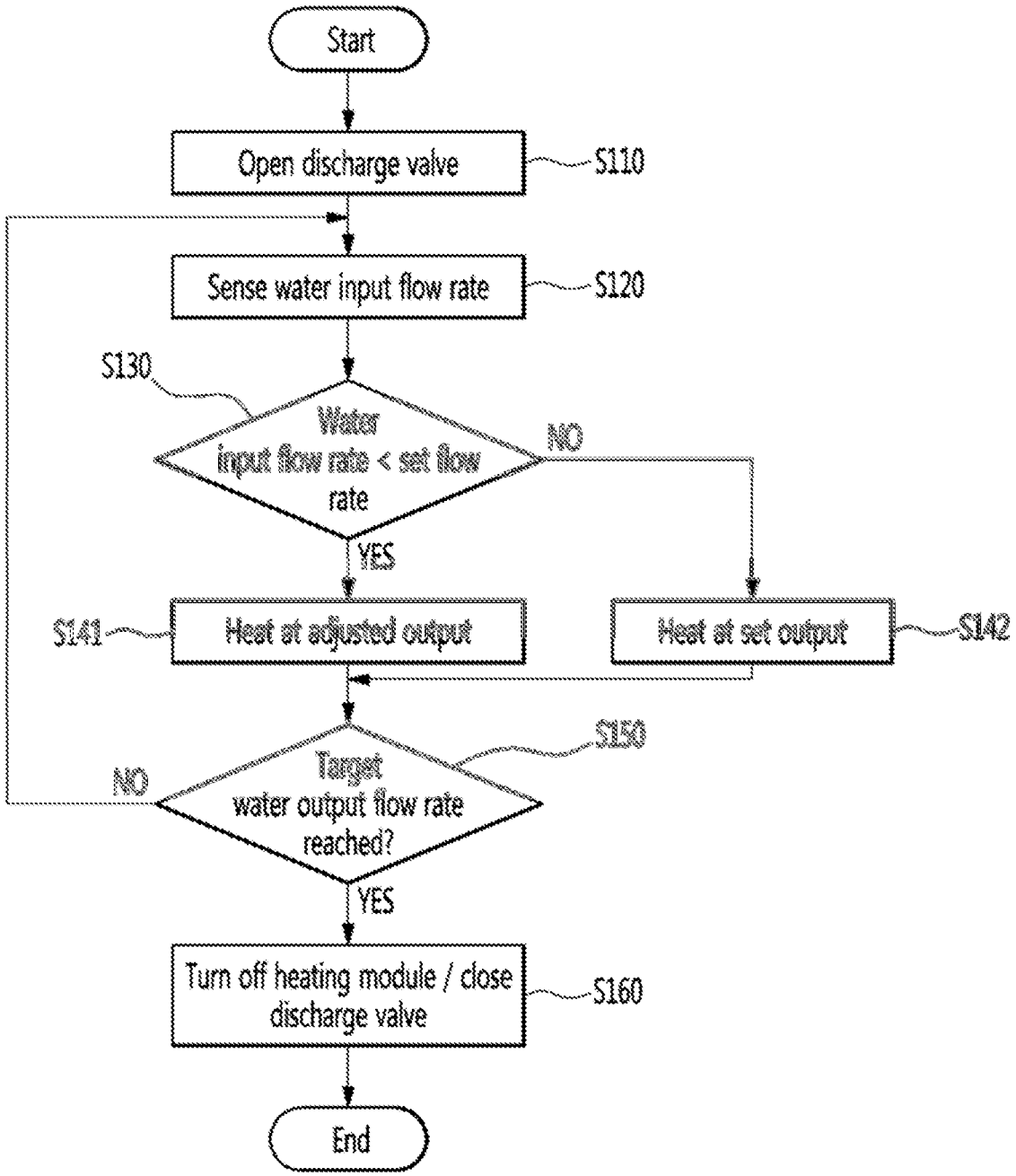
FIG. 5 is a flowchart sequentially illustrating a process of dispensing hot water from the water dispenser.

Referring to FIG. 5, a user may place a container under the nozzle 1212 and then operate the dispensing button 111 of the operation unit 110 to take hot water from the water dispenser 1. As the dispensing button 111 is operated, the discharge valve 222 may open and water may start to be supplied to the hot water tank 41 through the control valve 212 (S110).

When water starts to be supplied to the hot water tank 41, the flow sensor 211 may sense the flow rate of the water supplied. The flow rate of the water flowing into the hot water tank 41 may be controlled based on the opening ratio of the control valve 212. Accordingly, the water supplied to the hot water tank 41 may maintain a predetermined flow rate and the output of the induction heating assembly 40 or the working coil 42 may also be maintained at a predetermined level so that hot water may be uniformly supplied at a predetermined temperature.

However, the flow rate of the water supplied through the supply pipe 21 may be rapidly reduced due to external factors when water is being dispensed from the water dispenser 1. For example, when a large amount of water is used by an appliance, such as, e.g., a washing machine or a dishwasher in a bathroom or a kitchen while or immediately before water is supplied to the water dispenser 1, the flow rate of the water that is supplied to the water dispenser 1 may be rapidly reduced. When such simultaneous use of water frequently occurs, the temperature of hot water that is dispensed may not be maintained at a predetermined level.

Figure 6A:
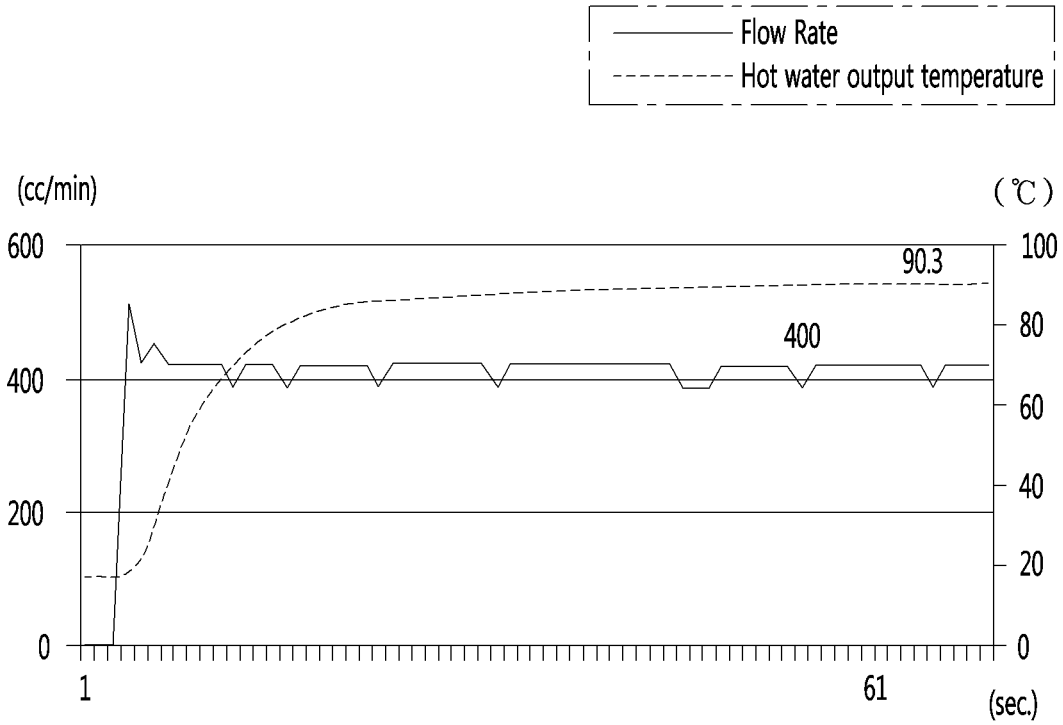
FIG. 6A and FIG. 6B are graphs showing a change in water output temperature according to a change in flow rate.

Referring to FIG. 6A, when the flow rate of water supplied to the hot water tank 41 is reduced by 20% from a target flow rate (about 0.4 LPM) with the working coil 42 operating with output of 2,550 W to supply hot water, the temperature of the dispensed water may be about 90.3° C. The temperature may be slightly higher than a target water output temperature, but an amount of produced steam may be minimal.

Figure 6B:
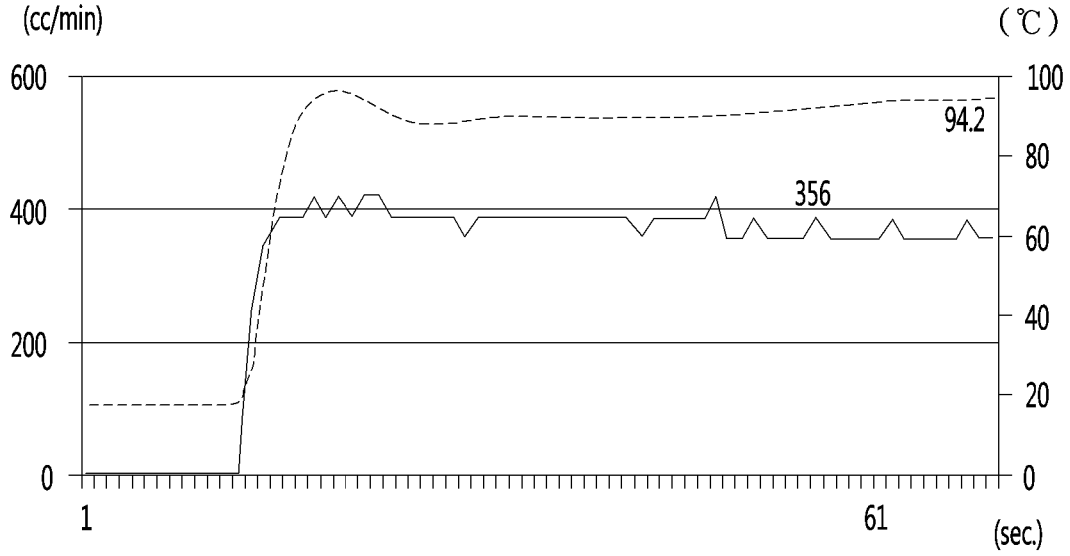

Referring to FIG. 6B, when the flow rate of water supplied to the hot water tank 41 is reduced by 30% from a target flow rate (about 0.356 LPM) with the working coil 42 operating with output of 2,550 W to supply hot water, the temperature of the dispensed water is about 94.2° C. The temperature may be higher than the target water output temperature and steam may be produced, so if water is supplied at a flow rate lower than the flow rate, water at a higher temperature may be dispensed and a large amount of steam may be produced, which may deteriorate durability and safety for the user.

In order to prevent damage to components of the water dispenser 1 and dispense hot water more safely by maintaining the water output temperature at a predetermined level, an exact flow rate of the water may be sensed that flows into the hot water tank 41 (S120). Referring to FIG. 6B, when the flow rate of water supplied is reduced over about 30% from a set or prescribed flow rate, dispensing hot water may be dangerous due to too much steam and an excessive increase in temperature of the hot water.

Accordingly, when a water input flow rate is lower than the set flow rate, it may be possible to control the output of the working coil 42 through the controller 50. In detail, the set flow rate may be set 30% smaller than the target flow rate that is supposed to be supplied through the supply pipe 21. The set flow rate may be adjusted, if necessary, but it may be set 30% smaller than the target flow rate to prevent steam from being produced due to an excessive increase of the water output temperature.

The controller 50 may compare the current flow rate inputted from the flow sensor 211 with the set flow rate (S130). Accordingly, when the water input flow rate is lower than the set flow rate, the controller 50 may reduce the output of the working coil 42. The output of the working coil 41 to be reduced may be determined to correspond to the reduced ratio of flow rate. When the water input flow rate is very reduced, the output of the working coil 42 may be adjusted lower.

When the output of the working coil 42 is reduced, the temperature of the hot water heated in the hot water tank 41 may be decreased in proportion to the output, and as a result, the temperature of water dispensed may be maintained at a final target temperature (S141). When the water input flow rate is larger than the set flow rate or equal to the target flow rate, the working coil 42 may operate at set output. Accordingly, the temperature of water dispensed may be maintained at an initial target temperature or within a target temperature range (S142).

Therefore, hot water may be dispensed at a predetermined temperature, for example, the target temperature, through the nozzle 121 even while the flow rate of water supplied is changed. The flow sensor 211 may determine whether a target output flow rate set by a user has been reached.

If the controller 50 determines that the target output flow rate has not been reached, water may keep being supplied to the hot water tank 41 until the target output flow rate is reached, and the controller 50 may keep monitoring a change in water input flow rate and adjust the output of the working coil 42 in accordance with a change in water input flow rate, thereby heating the water flowing through the hot water tank 41 (S150). When the controller 50 determines that the target output flow rate has been reached, the hot water module 30 and the working coil 42 may stop operating, the discharge valve 222 may close, and the operation of dispensing hot water may be finished (S160).

Figure 7:
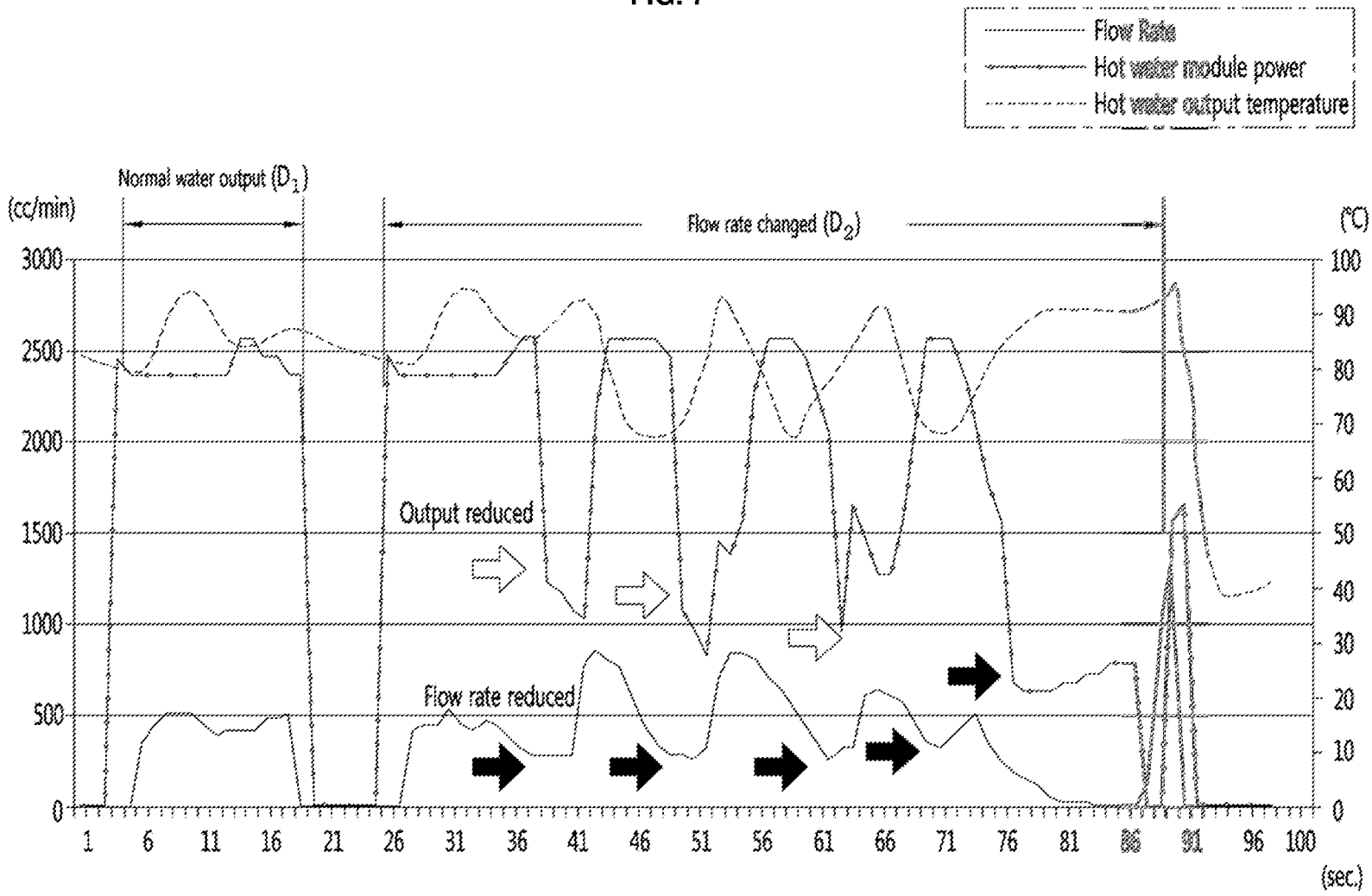
FIG. 7 is a graph showing flow rate, output of the hot water module, and water output temperature of the water dispenser.

Referring to FIG. 7, water may be supplied at a target flow rate in a normal water output period D1, and accordingly, the water passing through the hot water tank 41 may be heated at a set or prescribed output by the working coil 42. Since the water input flow rate is not much changed, the output of the working coil 42 may also be maintained without a large change. The temperature of water dispensed may be maintained at 85° C.~9° C.

The water input flow rate may be reduced under a set or prescribed flow rate while hot water is dispensed in a flow rate change period D2, in which the controller 50 may reduce the output of the working coil 42 when the water input flow rate decreases under the set flow rate. Accordingly, the temperature of the water dispensed may be maintained under about 90° C. without rapidly increasing even though the flow rate may rapidly decrease. The change of flow rate and adjustment of output of the working coil 42 may occur several times during one dispensing period, and it may take more time to reach a target water output flow rate due to the reduction in flow rate.

Another embodiment of the present disclosure may be characterized by controlling the output of the working coil, depending on a change in a water output temperature, by measuring a water output temperature through the controller so that hot water may be dispensed at a predetermined temperature.

A water dispenser according to such another embodiment of the present disclosure may have the same configuration as the embodiment described above, but may be different in terms of a control method, so same components may be given same reference numerals and may not be described in detail.

Figure 8:
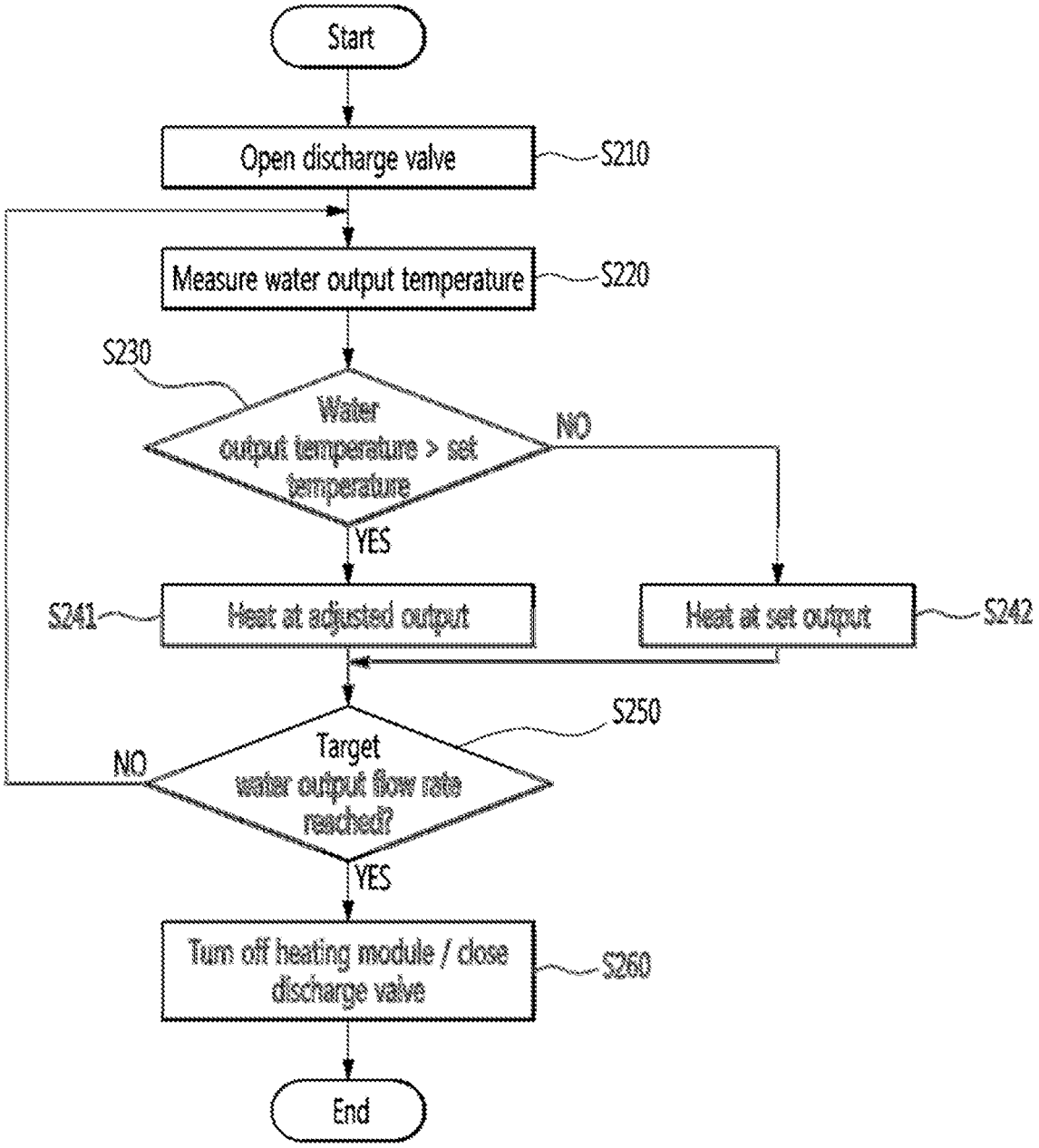
FIG. 8 is a flowchart sequentially illustrating another process of dispensing hot water from the water dispenser.

Referring to FIG. 8, a user may place a container under the nozzle 1212 and then operate the dispensing button 111 of the operation unit 110 to dispense hot water from the water dispenser 1. As the dispensing button 111 is operated, the discharge valve 222 may open, and water may start to be supplied to the hot water tank 41 through the control valve 212 (S210).

When water starts to be supplied to the hot water tank 41, the temperature sensor 221 may sense the temperature of the water discharged through the discharge pipe 22. The flow rate of water flowing into the hot water tank 41 may be maintained at a predetermined level based on the opening ratio of the control valve 212, the output of the induction heating assembly 40, that is, the working coil 42 may also be maintained at a predetermined level, and hot water may be uniformly provided at a predetermined temperature.

However, the flow rate of the water supplied through the supply pipe 21 may be rapidly reduced due to external factors when water is being dispensed from the water dispenser 1. When the flow rate is rapidly reduced, the water output temperature may be rapidly increased, and a large amount of vapor may be produced and deteriorate durability of the product and safety for the user. In order to prevent damage to the components in the water dispenser 1 and dispense hot water more safely by maintaining the water output temperature at a predetermined level, the water output temperature may be measured by the temperature sensor 221 (S220).

When the water output temperature is lower than a set or prescribed temperature, the controller 50 may control the output of the working coil 42. For example, the set temperature may be set higher by a predetermined level than a target water output temperature. The set temperature may be adjusted, if necessary, but it may be set 5° C.~10° C. higher than the target temperature to prevent steam from being produced due to an excessive increase of the water output temperature.

The controller 50 may compare the current flow rate that is inputted from the temperature sensor 221 with the set flow rate (S230). When the water output temperature is higher than the set temperature, the controller 50 may reduce the output of the working coil 42. The output of the working coil 41 to be reduced may be determined to correspond to the increased ratio of temperature. Accordingly, the output of the working coil 42 may be adjusted lower when the water output temperature is relatively much higher than the target temperature When the output of the working coil 42 is reduced, the temperature of the hot water heated in the hot water tank 41 may be decreased in proportion to the output, and as a result, the temperature of water dispensed may be maintained at the final target temperature (S241).

When the water output temperature is the same as the target temperature or is within a predetermined target temperature range, the working coil 42 may operate at a set output. Accordingly, the temperature of water dispensed may be maintained at the initial target temperature or within the target temperature range (S242). Therefore, hot water may be dispensed at a predetermined temperature, that is, the target temperature through the nozzle 121, even while the flow rate of water supplied may be changed.

The flow sensor 211 may determine whether a target output flow rate set by a user has been reached. If the controller 50 determines that the target output flow rate has not been reached, water may keep being supplied to the hot water tank 41 until the target output flow rate is reached, and the controller 50 may keep monitoring a change in water output temperature and adjust the output of the working coil 42 in accordance with a change in water input flow rate, thereby heating the water flowing through the hot water tank 41 (S250).

When the controller 50 determines that the target output flow rate has been reached, the hot water module 30, that is, the working coil 42, may stop operating, the discharge valve 222 may close, and operation of dispensing hot water may be finished (S260).

A water dispenser according to another embodiment of the present disclosure may be mounted on the door of a refrigerator to dispense water or ice, other than a water purifier. Such an embodiment of the present disclosure may have the same hot water module and internal configuration thereof except for a structure of the case for mounting the water dispenser.

Figure 9:
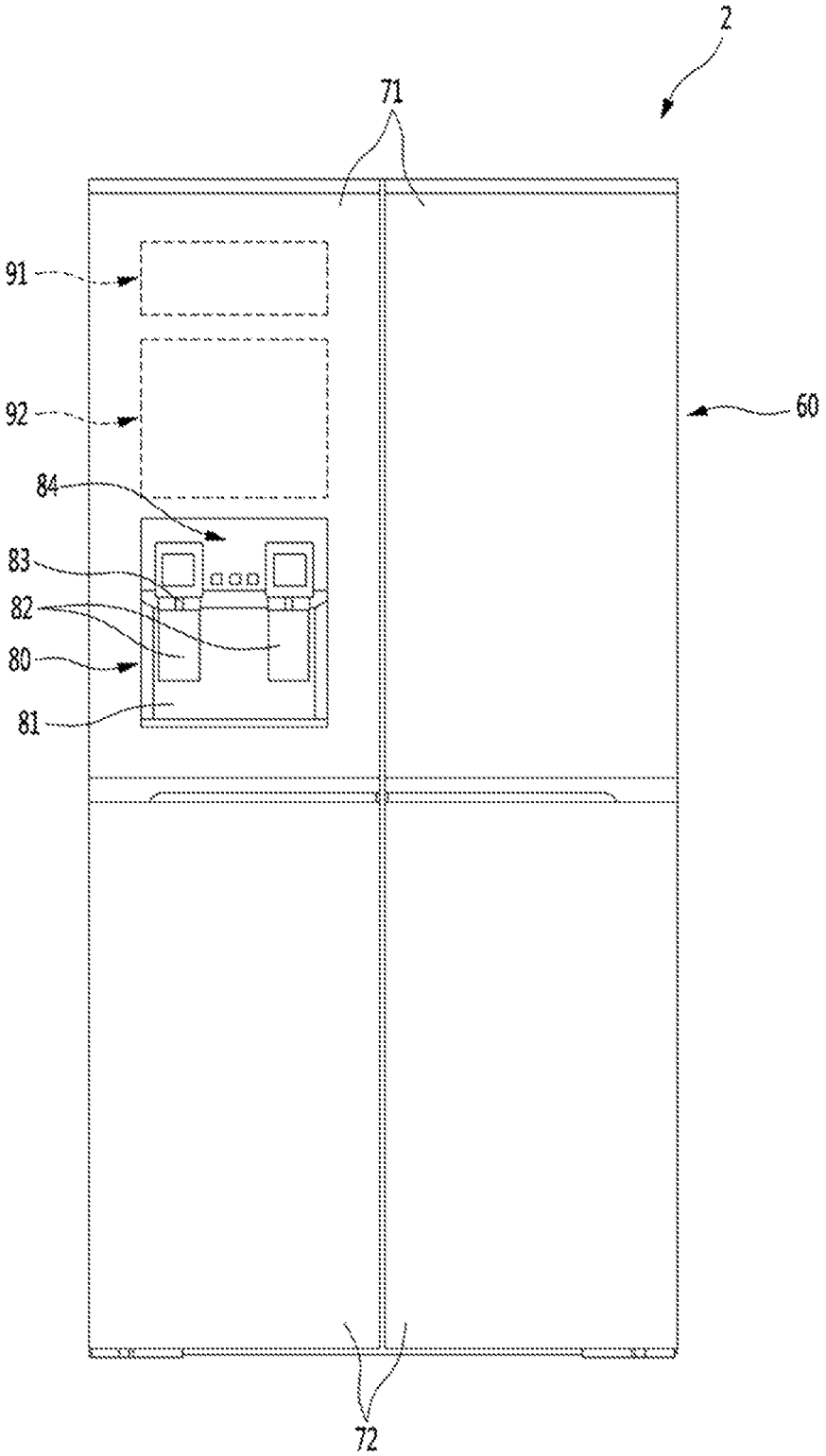
FIG. 9 is a front view of a refrigerator equipped with a water dispenser according to the present disclosure.
Figure 10:
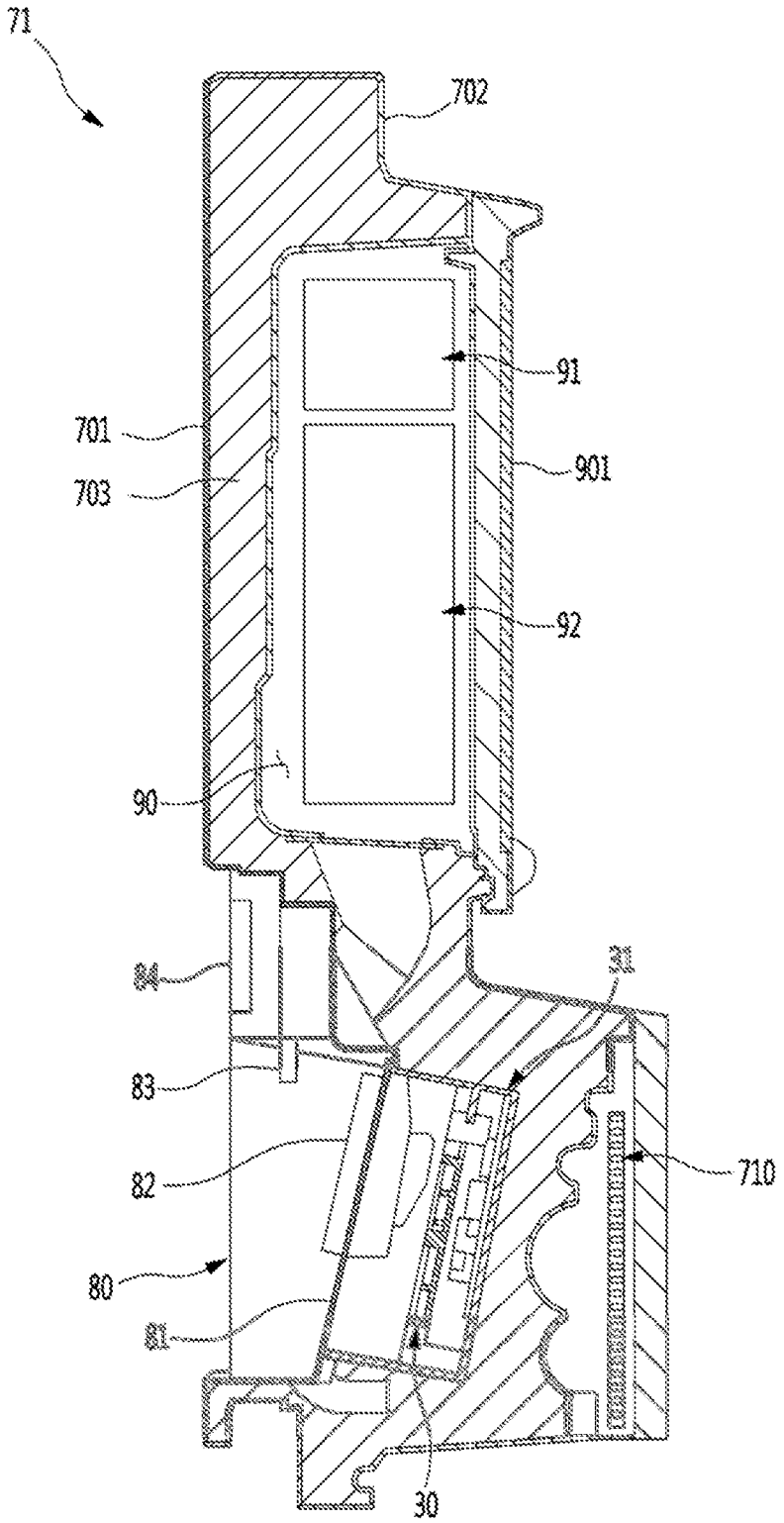
FIG. 10 is a cross-sectional view of a refrigerator door equipped with the water dispenser.

Referring to FIG. 9 and FIG. 10, a water dispenser 80 according to another embodiment of the present disclosure may be mounted on a refrigerator. A refrigerator 2 may have an external shape formed by a cabinet 60 having a storage space and doors 71 and 72 for opening/closing of the front of the cabinet 60. The storage space may be divided into a refrigerator compartment and a freezer compartment, and these compartments may be opened/closed by a refrigerator door 71 and a freezer door 72, respectively.

The water dispenser 80 may be provided on a front of the refrigerator door 71. The water dispenser 80 may be provided for a user to get water from the refrigerator 2. An ice maker compartment 90, which may be an independent insulating space and opened/closed by an ice maker compartment door 901, may be formed in the refrigerator door 71. An ice maker 91 and an ice bank or container 92 that makes and holds ice may be provided in the ice maker compartment 901. The ice bank 92 may be connected to the water dispenser 80 so that ice may be dispensed out through the water dispenser 80.

The water dispenser 80 may include a dispenser case 81 mounted on the front of the refrigerator door 71 to provide a recessed space. The dispenser case 81 may provide a space in which a container for taking or dispensing water or ice may be put. An operation member (e.g., a lever or button) 82 to dispense water or ice may be provided on the inner side of the dispenser case 81, and a nozzle 83 may be provided over the operation member 82.

An operation unit (e.g., display or control panel) 84 may be provided over the case 81 for a user to be able to select various operations, such as, e.g., setting the kind, temperature, and amount of water to be dispensed from the water dispenser 80. It may be possible to output or display the operational state of the refrigerator 2 and an operation state set by the user through the operation unit 84.

The refrigerator door 71 may include an outer plate 701 forming the external shape of the front of the refrigerator door 71, a door liner 702 forming the shape of the rear of the refrigerator door 71, and an insulator 703 provided between the outer plate 701 and the door liner 702 to prevent heat exchange. The dispenser case 81 may be mounted on the outer plate 701.

A hot water module 30 may be provided behind the dispenser case 81 and may be received in a module case 31 behind the dispenser case 81. The module case 31 may be covered with or by the insulator 703 except for a surface in contact with the dispenser case 81, so heat generated by the hot water module 30 may not transfer into the refrigerator 2.

A cold water tank 710 that supplies cold water to the water dispenser 80 may be provided on a rear of the door liner 702 at a position corresponding to the hot water module 30 to prevent the heat from the hot water module 30 from transferring into the refrigerator.

The structure of the hot water module 30 of the water dispenser 80 having this structure may be the same as those in the previous embodiments, and the output of the hot water module may be controlled based on a change in flow rate of water supplied or a water output temperature. Therefore, it may be possible to maintain the water output temperature at a predetermined level even if the water input flow rate may be rapidly decreased while hot water is dispensed.

Embodiments disclosed herein may provide a water dispenser that may supply hot water at a predetermined temperature regardless of a supply flow rate, and a method of controlling the water dispenser. Embodiments disclosed herein may also provide a water dispenser that may supply hot water at a predetermined temperature by controlling an output of an induction heating type of hot water module based on reduction of a supply flow rate or a water output temperature.

According to embodiments disclosed herein, a water dispenser may include an induction heating assembly that heats water that is supplied; a supply pipe that supplies water to the induction heating assembly; a flow sensor that is provided on the supply pipe and senses an amount of water that is supplied to the induction heating assembly; and a controller that reduces output of the induction heating assembly when a flow rate of water sensed by the flow sensor is a set flow rate or less.

According to embodiments disclosed herein, a water dispenser may includes an induction heating assembly or induction heater that heats water that is supplied; a discharge pipe that discharges water heated by the induction heating assembly; a temperature sensor that is provided on the discharge pipe and senses a temperature of hot water that is discharged; and a controller that reduces output of the induction heating assembly when a temperature of hot water sensed by the temperature sensor is a set temperature or higher.

The induction heating assembly may include a hot water tank through which purified water passes; a working coil that is wound several times at a position facing the hot water tank and generates an electromagnetic force to heat the water of the hot water tank via induction heating; a plurality of ferrite cores that is circumferentially arranged around a center of the working coil to prevent a loss of the electromagnetic force generated by the working coil; and a mounting bracket on which the hot water tank, the working coil, and the ferrite cores are mounted.

The controller may be provided on a rear of the induction heating assembly and coupled to a rear of the mounting bracket. A safety valve that discharges vapor in the hot water tank may be provided at an exit of the hot water tank. A control valve that controls the flow rate of water that flows into the hot water tank may be provided at an inlet of the hot water tank.

The hot water tank may include a first cover that forms a side facing the working coil and has a flat shape and a second cover that is bonded to an edge of the first cover with a gap therebetween to form a space through which water flows. A plurality of foamed portions or spacers recessed toward the first cover to be in contact with the first cover may be formed at the second cover.

The controller may reduce the output of the induction heating assembly in proportion to a decrease of the water input flow rate or an increase in water output temperature. A control valve to control the flow rate of water that is supplied may be provided on the supply pipe and integrated with the flow sensor.

According to embodiments disclosed herein, a method of controlling a water dispenser having a discharge valve that may be opened by a user to dispense water, an induction heating assembly that heats and then discharges water that is supplied, and a controller that controls output of the induction heating assembly, the method including measuring a change in the flow rate of water supplied using the flow rate sensor; and dispensing water through the discharge valve, wherein a temperature of the water that is dispensed is maintained at a predetermined level based on a change in flow rate of the water that is supplied.

The controller may compare the flow rate of water that is supplied to the induction heating assembly with a set flow rate through a flow sensor, maintain the output of the induction heating assembly when the supplied flow rate is the set flow rate or more, and reduce the output of the induction heating assembly when the supplied flow rate is the set flow rate or less. The set flow rate may be set 20%~30% lower than a target flow rate. The output of the induction heating assembly may be reduced in proportion to a reduced ratio of the supplied flow rate.

The controller may compare the temperature of water that is discharged from the induction heating assembly with a set temperature through a temperature sensor, maintain the output of the induction heating assembly when the temperature of the water that is discharged is the set temperature or lower, and reduce the output of the induction heating assembly when the temperature of the water that is discharged is the set temperature or higher. The set temperature may be set 5° C.~10° C. lower than a target temperature. The output of the induction heating assembly may be reduced in proportion to an increased ratio of the temperature of the water that is discharged.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A water dispenser comprising:

a water storage tank to receive water;

an induction heater that heats water in the water storage tank;

a discharge pipe that discharges water heated by the induction heater from the water storage tank;

a temperature sensor provided on the discharge pipe, the temperature sensor configured to sense a temperature of water discharged from the discharge pipe; and a controller that reduces power output of the induction heater when the temperature of water sensed by the temperature sensor is a prescribed temperature or higher, and wherein the induction heater includes:

a coil that is wound and faces the water storage tank, the coil generating an electromagnetic force to heat the water in the water storage tank via induction heating;

a plurality of ferrite cores that is circumferentially arranged around a center of the coil to prevent a loss of the electromagnetic force generated by the coil; and a mounting bracket on which the water storage tank, the coil, and the plurality of ferrite cores are mounted.

2. The water dispenser of claim 1, wherein the controller is provided on a rear of the induction heater and coupled to a rear of the mounting bracket.

3. The water dispenser of claim 1, wherein a safety valve that discharges vapor in the water storage tank is provided at a portion of the water storage tank where water is discharged.

4. The water dispenser of claim 1, wherein a control valve to control a flow rate of water that flows into the water storage tank is provided at an inlet of the water storage tank.

5. The water dispenser of claim 1, wherein the water storage tank includes:

a first cover that forms a side facing the coil and has a flat shape; and a second cover that connects to an edge of the first cover such that a space is formed between the second cover and the first cover through which water flows.

6. The water dispenser of claim 5, wherein a plurality of foamed spacers recessed toward the first cover to be in contact with the first cover is formed at the second cover.

7. The water dispenser of claim 1, wherein the controller reduces the power output of the induction heater in proportion to an increase in temperature of water discharged.

* * * * *